US006186831B1

(12) United States Patent
Tsai

(10) Patent No.: US 6,186,831 B1
(45) Date of Patent: Feb. 13, 2001

(54) LINK BAR FOR CAPACITORS OF AUDIO SYSTEM

(75) Inventor: Liao-Tai Tsai, Taipei (TW)

(73) Assignee: Real Power Cap Company (TW)

( * ) Notice: Under 35 U.S.C. 154(b), the term of this patent shall be extended for 0 days.

(21) Appl. No.: 09/327,960

(22) Filed: Jun. 8, 1999

(51) Int. Cl.[7] ..... H01R 24/00
(52) U.S. Cl. ..... 439/627; 439/952; 174/70 B
(58) Field of Search ..... 439/507, 952, 439/627, 510, 511; 174/68.2, 70 B, 71 B

(56) References Cited

U.S. PATENT DOCUMENTS

| | | | | |
|---|---|---|---|---|
| D. 94,298 | * | 1/1935 | Frank | 174/68.2 |
| 3,663,923 | * | 5/1972 | Primoff et al. | 439/510 |
| 3,728,656 | * | 4/1973 | Neuber | 439/507 |
| 3,816,171 | * | 6/1974 | Toth et al. | 439/68.2 |
| 4,345,806 | * | 8/1982 | McHenney | 439/510 |
| 5,030,797 | * | 7/1991 | Logstrup | 439/507 |

OTHER PUBLICATIONS

H. B. Sherman Mfg. Co. advertisement is Electrical Record, p. 224, Apr. 1925.*

* cited by examiner

*Primary Examiner*—T. C. Patel
(74) *Attorney, Agent, or Firm*—Birch, Stewart, Kolasch & Birch, LLP

(57) ABSTRACT

The present invention relates to a link bar for capacitors of an audio system, comprising a conducting portion and a connecting portion for connecting electrical poles of the capacitors together. The connecting portion stretches between the conducting portion. The link bar can be connected with another link bar by overlapping the connecting portions which will have the same height as the conducting portion after overlapping. In using the link bar, the desired number of capacitors are chosen and the link bars are assembled by mutually contacting the connecting portions. The maker can use one single link bar to connect capacitors instead of several kinds with various specifications of link bars.

13 Claims, 10 Drawing Sheets

LINK BAR FOR CAPACITORS OF AUDIO SYSTEM

FIELD OF THE INVENTION

The present invention relates generally to a link bar for the capacitor of a car audio system. More particularly, the present invention relates to a conjunctive bar used for connecting plural capacitors of car audio system in parallel.

BACKGROUND OF INVENTION

Normally car's battery supplies a car's power system. However, the car's battery may be in shortage when car's audio system needs more power in higher current. This consequently reduces the voice quality of the audio system. It is the reason why a capacitor is placed in parallel between the amplifier of audio system and the battery to prevent the shortage of high current power supply.

A capacitor is capable of charging a large quantity of electric power, and discharges in short time if needed. Thus, a car is, in general, equipped with a capacitor to supply sufficient power needed by the amplifier of audio system, in particular, when the demand for power is large. For example, the audio system is playing a chapter with super bass melody. Moreover, this device can make the bass response of the audio system stronger.

Another object to install capacitor in a car's audio system is to filter out some signal. When the power source connects the amplifier of car's audio system, it usually simultaneously produces some zigzag wave signal. 'I'he zigzag wave signal, then, causes some audible noise signal in the audio system, therefore affecting the voice quality.

According to the forgoing description about the capacitor of a car's audio system, it is the reason why almost every car is equipped with capacitor therein. In general, a single capacitor can not satisfy the watt power needed for car audio. To connect plural capacitors in parallel is, therefore, needed by constructing a link bar between them. There are several locking holes in link bar in order to lock up capacitors together in parallel. The conventional link bar is always designed an unchangeable number of holes, and can not be freely assembled to each other.

Under some conditions, it may be another trouble that the maker needs to create some other types of link bar with different number of holes to meet the condition that the number of desired capacitors differs from the present one. To assemble them after choosing a suitable link bar with correct number of holes is then the other work to get all capacitors been connected together.

For example, as users want to connect two capacitors in parallel, they must choose a link bar 10 shown in FIG. 1. This link bar 10 has a bolt hole 11 in both ends provided for a bolt 12 to get through and lock on to one pole, positive or negative, of the capacitor 20 to connect these two capacitors 20 together.

Accordingly, as users would like to connect three capacitors in parallel, the condition changes and differs from that practiced as in FIG. 1. The link bar 10*a* shown in FIG. 2 is then needed. This link bar 10*a* has three bolt hole 11 thereon and is locked to three capacitors in order to get these capacitors connected in parallel. Of course, users can connect other number, such as four or more, of capacitors together and, therefore, must select a specific link bar with the same number of holes to meet the need. As a result, the maker must create numeral specifications of link bars and manufacture the link bar with various numbers of holes to meet the need. Consequently, the cost raises for manufacturing these kinds of link bars.

Referring to FIG. 3, when assembling link bars to capacitors, it is necessary to add a terminal 13 to connect the electrical wire thereon by way of locking the terminal 13 together with the bolt hole of the end side of link bar 10 on the same pole of the capacitor 20.

In the conventional method of assembling, the terminal 13 is locked together with link bar 10 to the same pole by means of leading a bolt 12screwing into the terminal 13 the bolt hole 11 of link bar 10. However, as the side wall 16 of link bar 10 is arc-shaped and can not contact tightly together with the end face 14 of the terminal 13 face to face, the side wall 16 and the end face 14 contact with each other in the situation of point to surface instead, that is, the end face 14 is not in fully contact with the side wall 16, and there exists a clearance between them. This may result in a serious trouble that the terminal 13 will turn around the bolt hole 11 for lacking a stop force against it during locking procedure, This situation may be dangerous and cause a short circuit of the released positive and negative poles of the capacitor.

SUMMARY OF THE INVENTION

Accordingly, the present invention provides mainly a link bar for capacitors of car audio system which is capable of assembling with each other and overlaps one another on both ends of link bar to construct a series of link bars, which, then, benefits users to compose link bars in different desired numbers of locking holes and obtain the flexibility of assembling and cost reduction by manufacturing only one single type of link bar.

In order to meet the object of the present invention, a link bar of the present invention comprises a conducting portion and a connecting portion for connecting electricity poles of said capacitors together. The connecting portion which stretches outward from both ends of the conducting portion can be connected with each other by overlapping the same, and has the same height as the conducting portion after overlapping the connecting portion for the users to utilize the desired number.

Another object of the present invention is to reduce the wobbling condition of the terminal during locking process.

To obtain the result the present invention has, at least, a flat surface that can tightly contact with the surface of the terminal in order to provide a supporting force to prevent the terminal from rotating during locking process.

These and other features of the present invention will become more fully apparent from the following description and dependent claims taken in conjunction with the accompanying drawings.

BRIEF DESCRIPTION OF THE DRAWINGS

The present invention is illustrated by the following drawings which are given by way of illustration only, and thus are not limitive of the present invention, and in which.

DETAILED DESCRIPTION OF THE PREFERRED EMBODIMENT

Embodiments of the present invention provide a link bar which can be mutually assembled with each other, which has connecting portion at both ends for locking on to connecting portion of the capacitor, and which can construct a series of link bars by overlapping the connecting portions thereof respectively. Therefore, this combines several capacitors in parallel and provides a flexible way to connect capacitors together easily for users who would like to connect a certain number of capacitors together.

Figure 4:
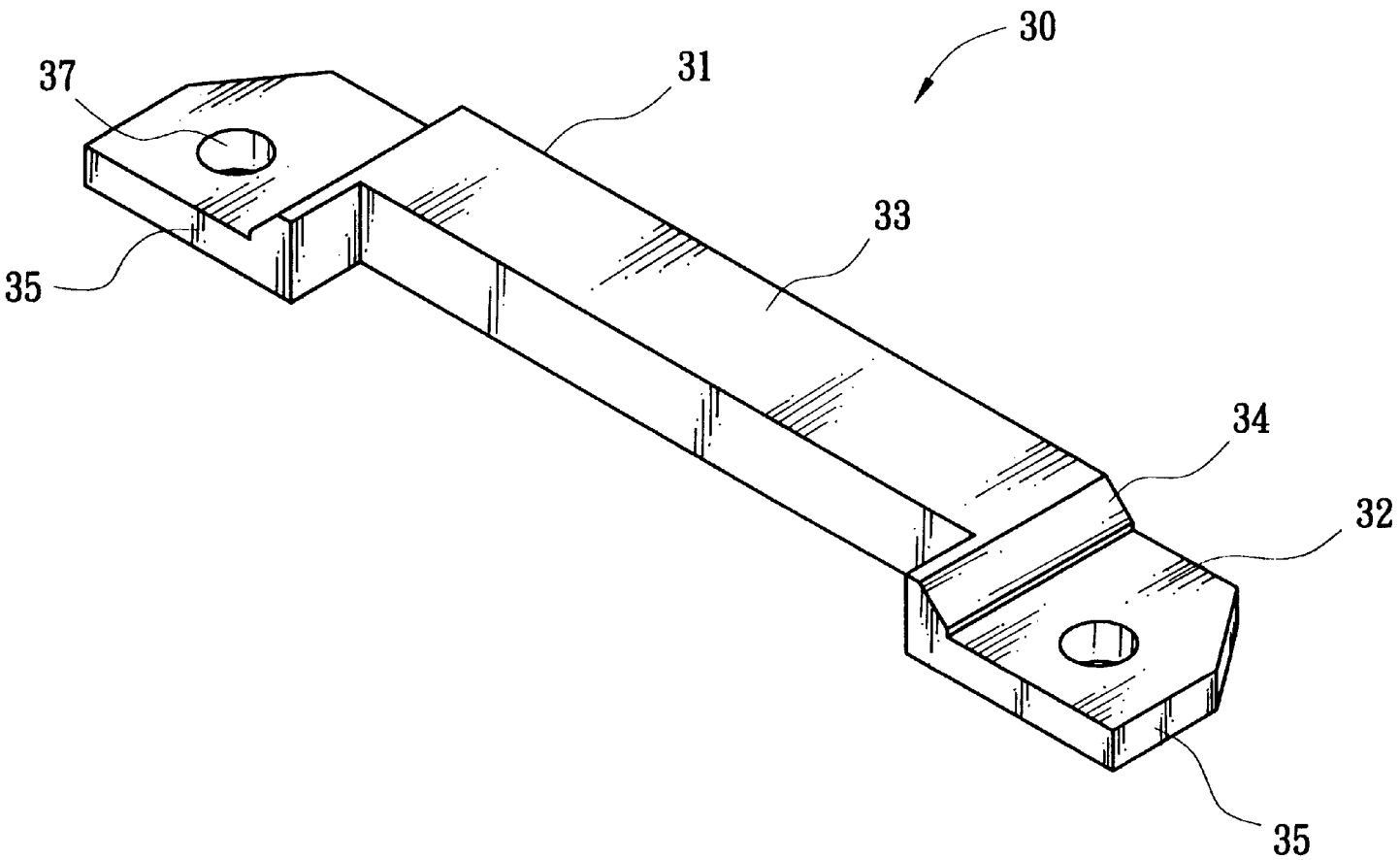
FIG. 4 is a perspective view of the detailed structure of the embodiment of the present invention.

The structure, assembling procedure and the usage of forgoing link bar is further described below. Firstly, referring to FIG. 4, it shows the perspective view of the structure of the present link bar. As illustrated in FIG. 4, the link bar 30 includes, at least, a conductor 31 consisting of a conducting portion 33 and tilt plates 34 stretching outward from both ends of conducting portion 33, and connecting portions 32 that stretch outward with a half height of the conducting portion 33 and has a locking hole 37 thereon provided for a locking part to go through and then lock the connecting portion 32 to one electric pole of the capacitor. Accordingly, the length of the conducting portion 33 is about half the distance between the electric poles of two capacitors. The connecting portion 32 has the outline of pentagon, or multilateral shape. In addition, there is an end face 35 on its four sides having different length.

Figure 5:
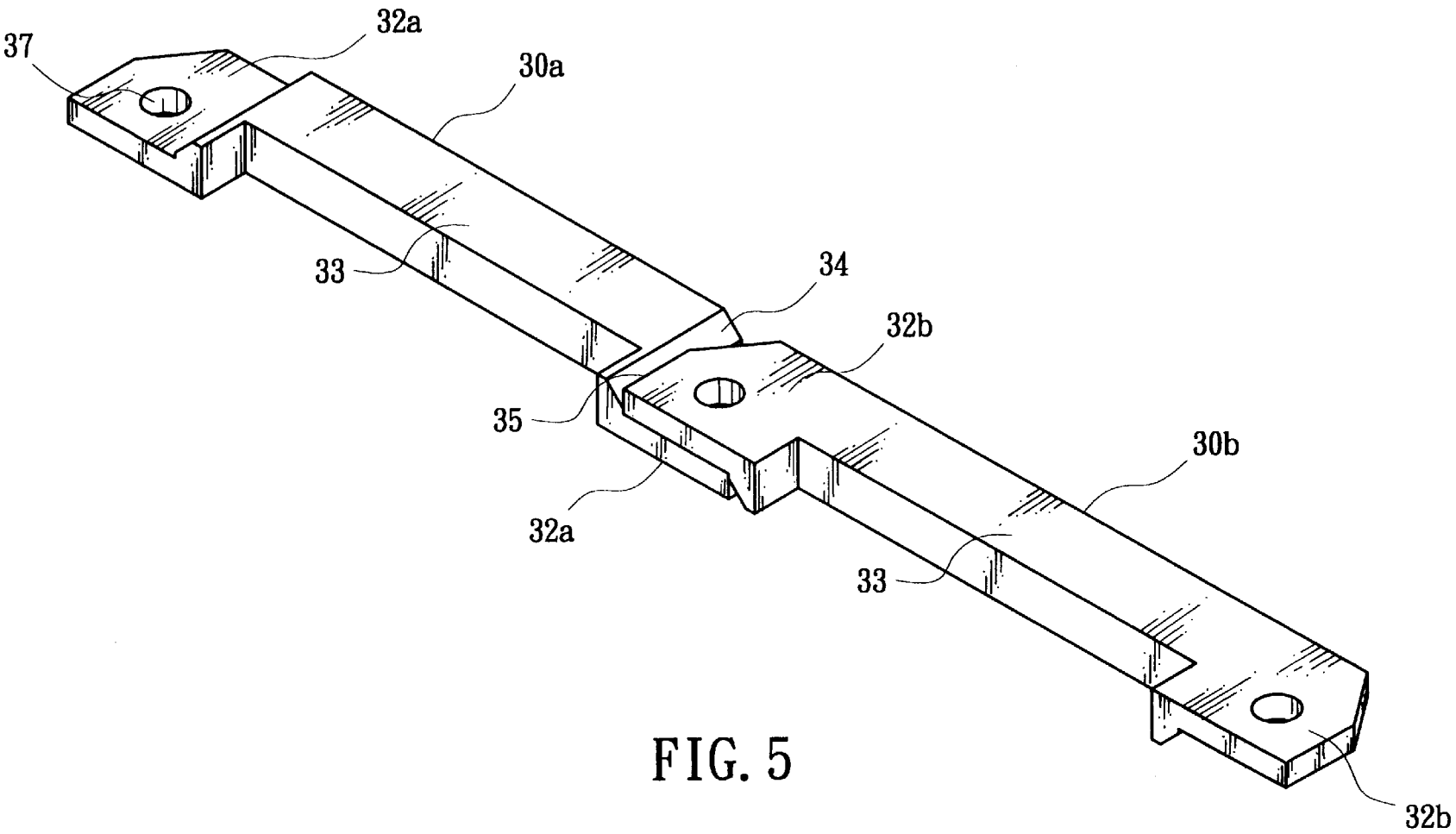
FIG. 5 is a perspective view of FIG. 4 depicting the link bar that is assembled with another one turned to opposite side.

Since the structure and the outline of the present invention, the link bar 30, are suitably designed, any connecting portion 32 of the link bar 30 can be assembled together by overlapping connecting portion 32 with another one to form a series of link bars. As shown in FIG. 5, the assembling method is firstly to choose one link bar which is upward placed, referred to link bar 30*a* thereafter, and the other link bar which is downward placed, referred to link bar 30*a* thereafter. When assembling them, to correctly put the connecting portion of the link bar 30*b*, referred to connecting portion 32*b* thereafter, on the connecting portion of link bar 30*a*, referred to connecting portion 32*a* thereafter, enables both of the locking hole 37 to precisely match each other and thus forms a link bar with three locking holes 37. It is obvious that the other connecting portion of the link bar 30*a* and the link bar 30*b* also can be mutually connected to other link bars. Therefore, another kind of combined link bar can be assembled by users as required. When overlapping two connecting portion, the tilt plate 34 and the end face 35 of the downward connecting portion 32*b* are contacting with the end face 35 and the tilt plate 34 of upward connecting portion 32*a*. At this moment, the height of these two connecting parts, upward connecting portion 32*a* and downward connecting portion 32*b*, after piling up is equal to the height of the conducting portion 33 so as to prevent the uneven situation while assembling them to the capacitor.

Figure 1:
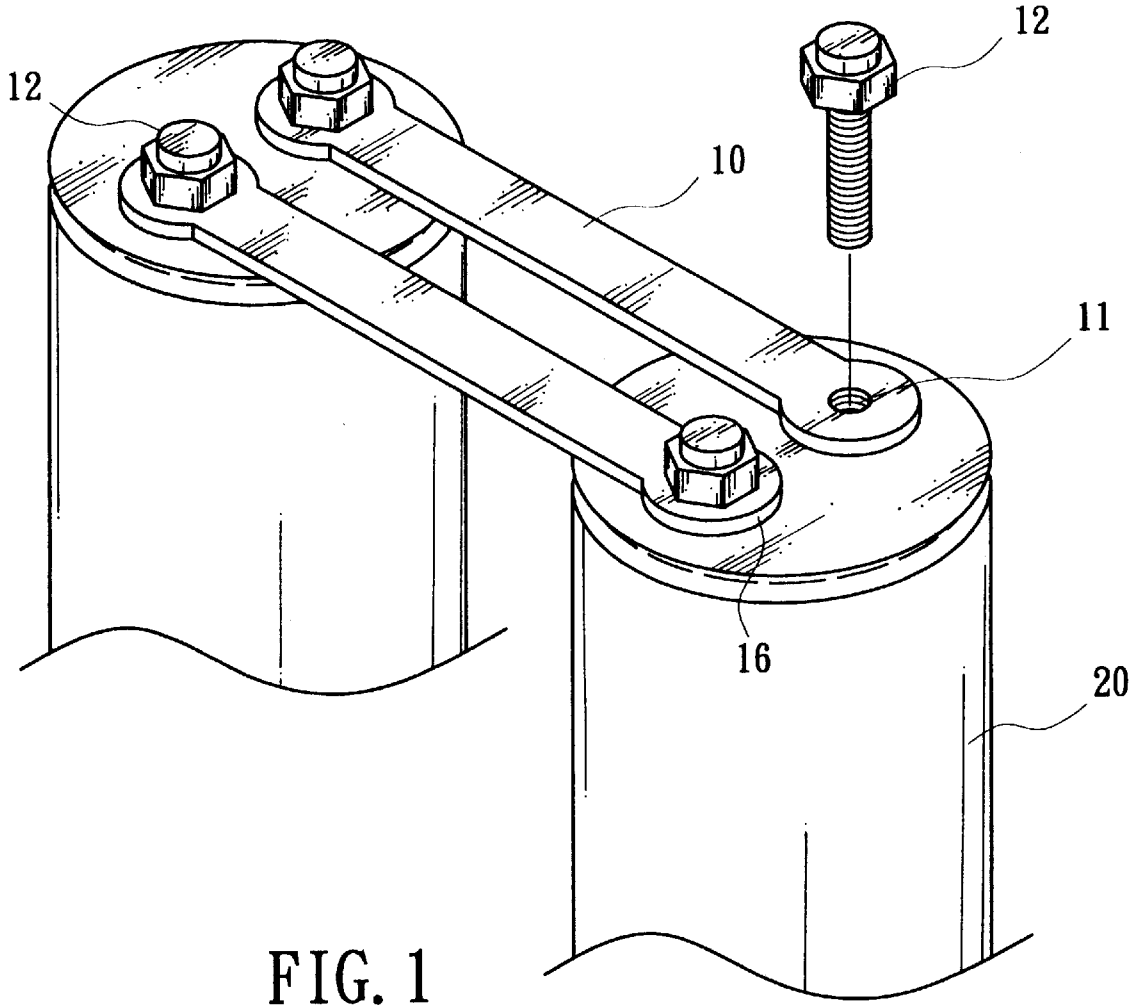
FIG. 1 (PRIOR ART)
FIG. 1 is a perspective view of conventional link bars that connect two capacitors together.
Figure 2:
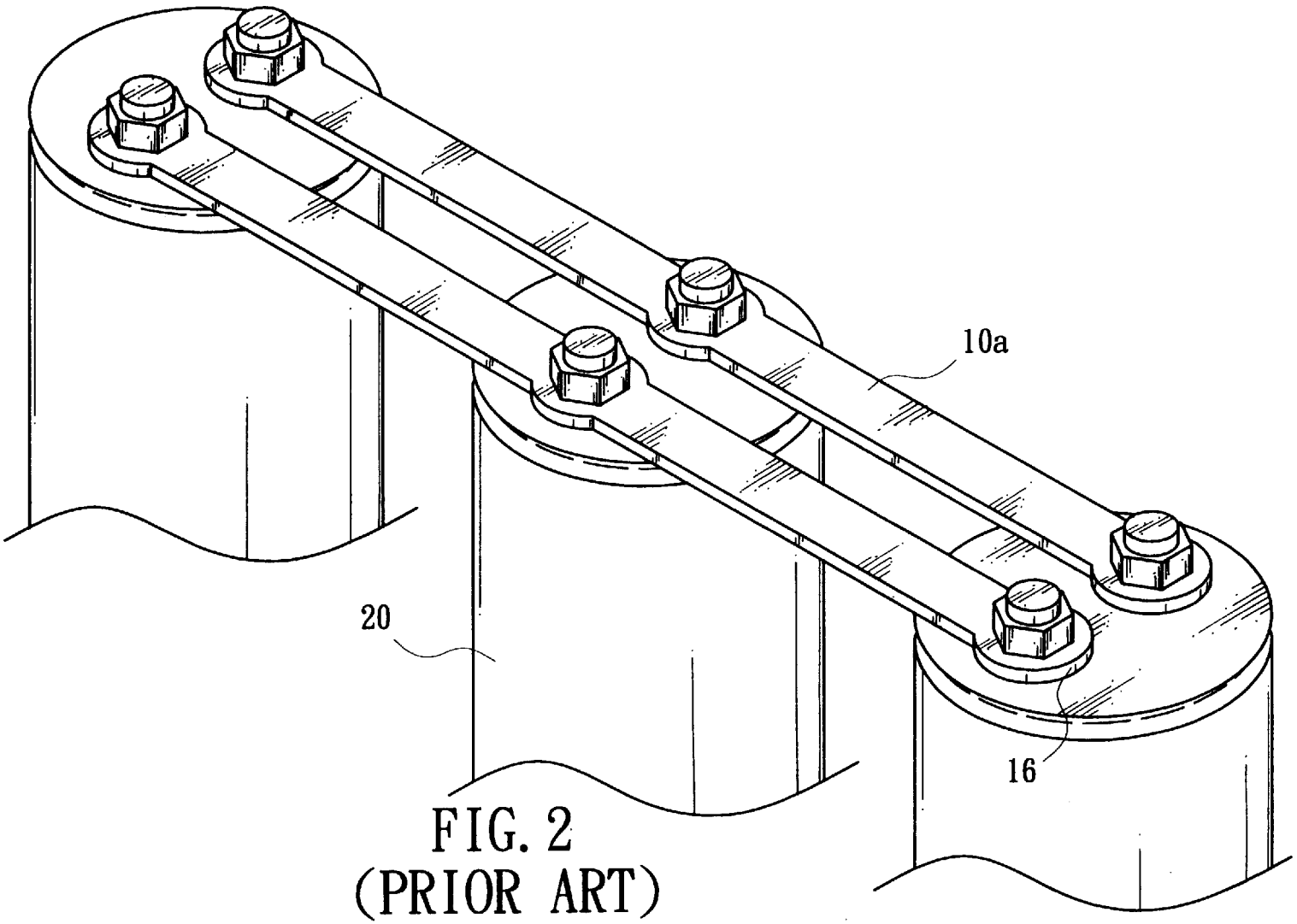
FIG. 2 (PRIOR ART)
FIG. 2 is a perspective view of another conventional link bars that connect three capacitors together.
Figure 3:
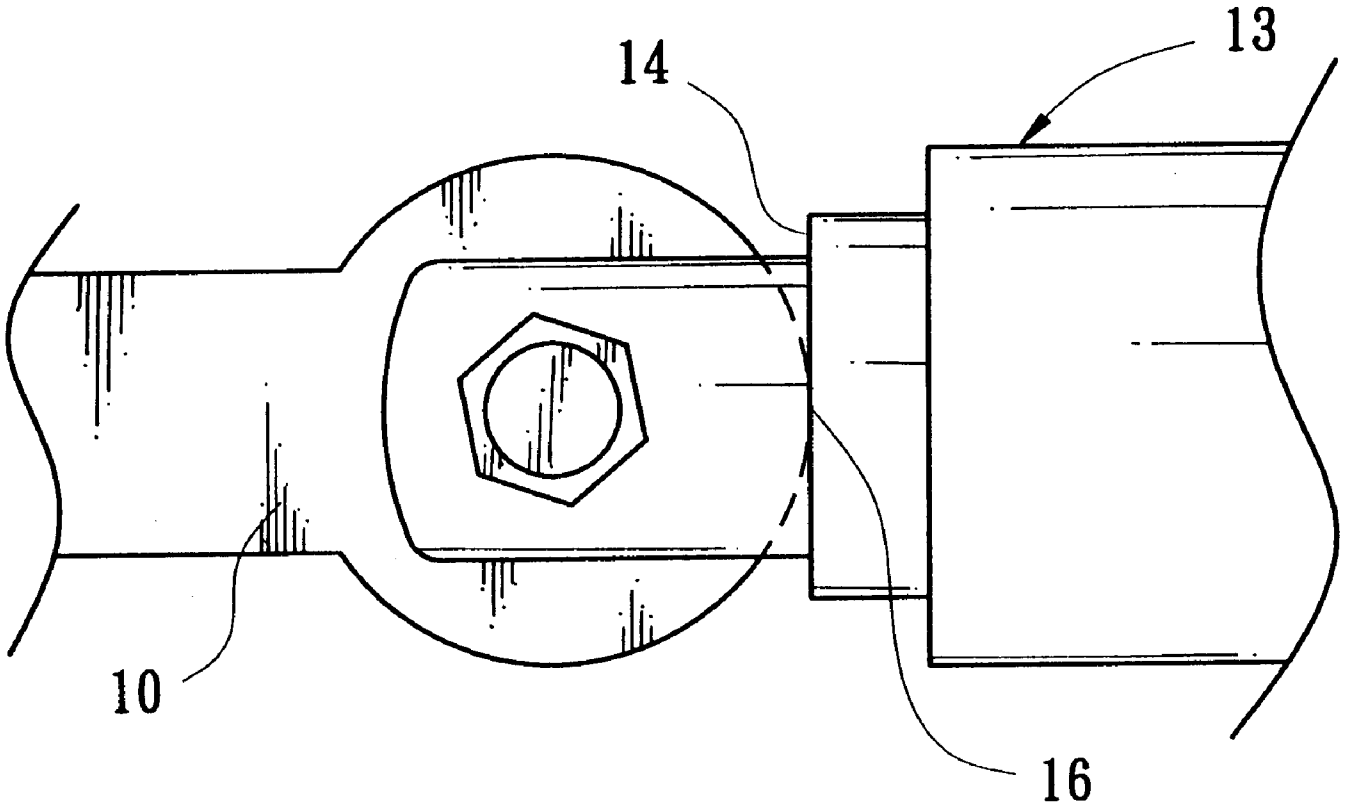
FIG. 3 (PRIOR ART)
FIG. 3 is an enlarged perspective view of conventional link bars and their bolt holes depicting that the side surface of the link bar can not fully contact the end surface.
Figure 6:
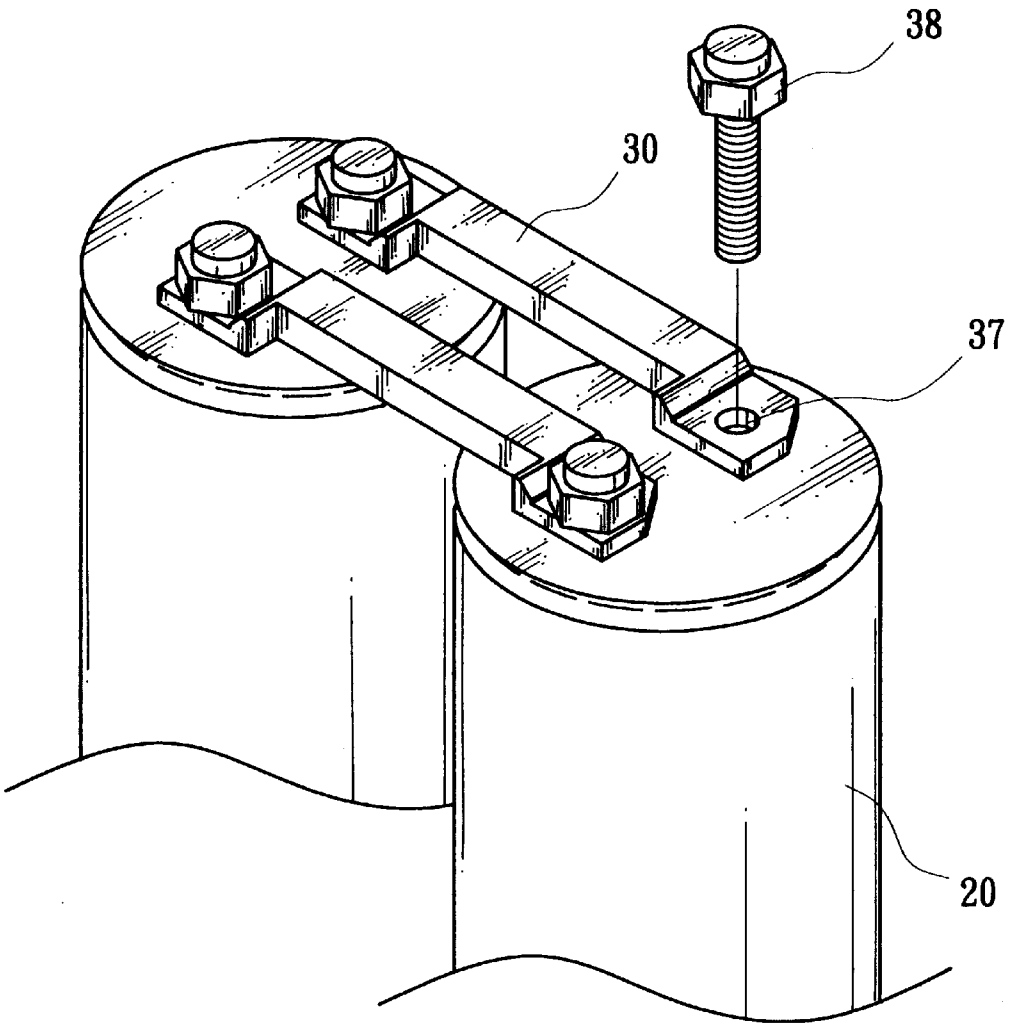
FIG. 6 is a perspective view of the present invention, depicting the practicing of link bars connecting two capacitors in parallel.

Besides, it becomes very flexible and versatile in utilization that the serial link bar having locking holes needed to fit capacitors is composed of selecting the needed number of link bar in series. For example, when users would like to connect two capacitors 20 in parallel, simply locking the locking hole 37 already existing on the link bar itself to the electric poles of the capacitor 20 by putting locking part 38 through the locking hole 37, as is illustrated in FIG. 6. When applying more than two capacitors 20 is needed, for example, three capacitors 20, it is no need to take a link bar which is specially made to have three locking holes 37 on it, as in FIG. 2.

Figure 7:
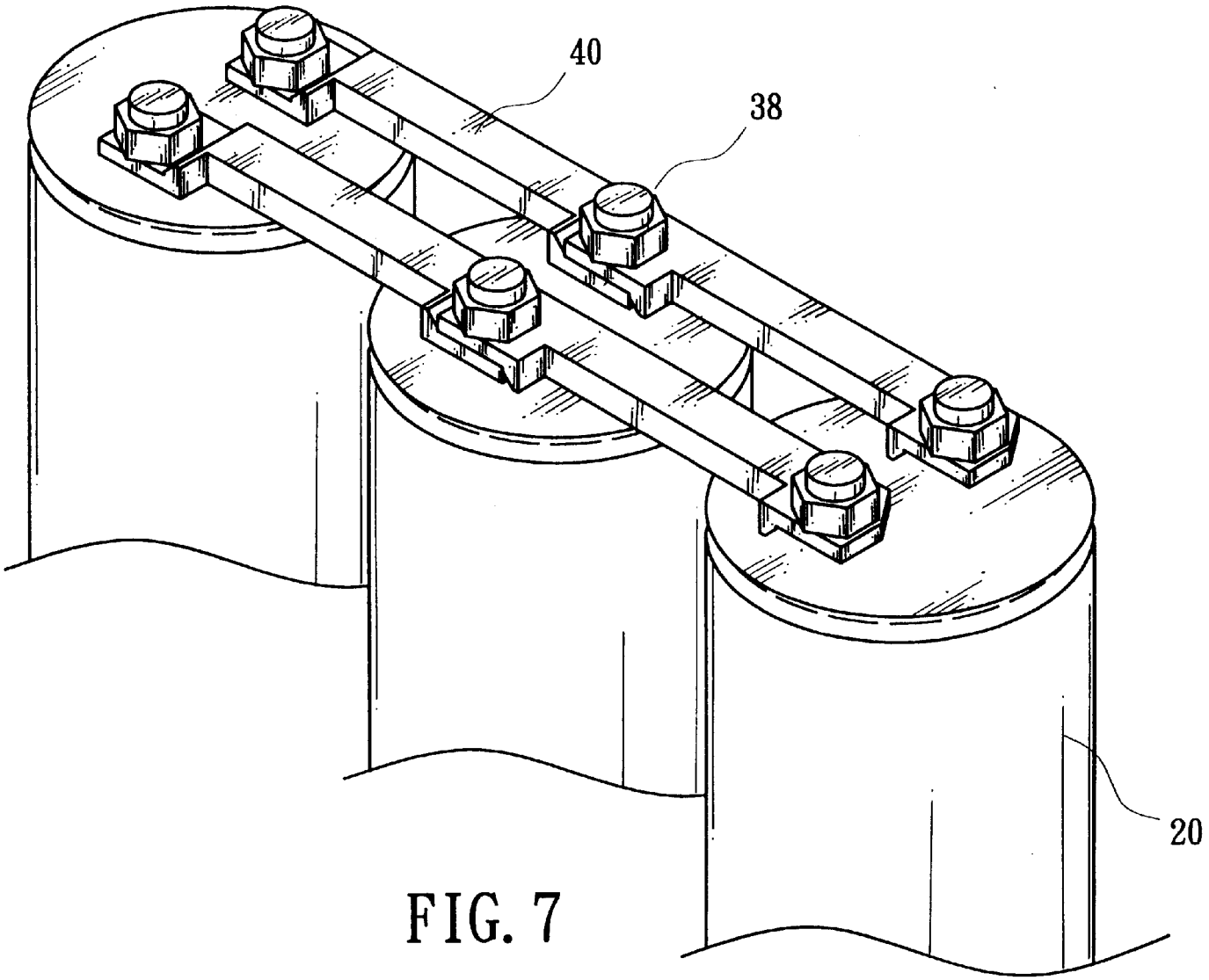
FIG. 7 is a perspective view of the present invention, depicting the practicing of link bars connecting three capacitors in parallel.

Under this condition, referring now to FIG. 5, applying two link bars 30 of the present invention and getting them assembled can do it. A composed serial link bar 40 with three locking holes 37 on it is then easily composed. The next procedure is to separately lock these three locking holes 37 to those three electric poles of capacitor 20 in turn. Referring to FIG. 7, these three capacitors 20 are eventually connected in parallel.

Needless to say, if users would like to connect four or more capacitors 20, it is easy to achieve the requirement by fetching several link bars which have the total number of locking holes 37 the same as that of capacitor 20 and getting them assembled as described above. By the way introduced as forgoing, the maker just need to manufacture one single type of link bar and easily make it suitable to be applied on various numbers of capacitor 20. To make many kind of capacitor 20 is no longer needed, the manufacturing fee and cost are thus lowered.

Figure 8:
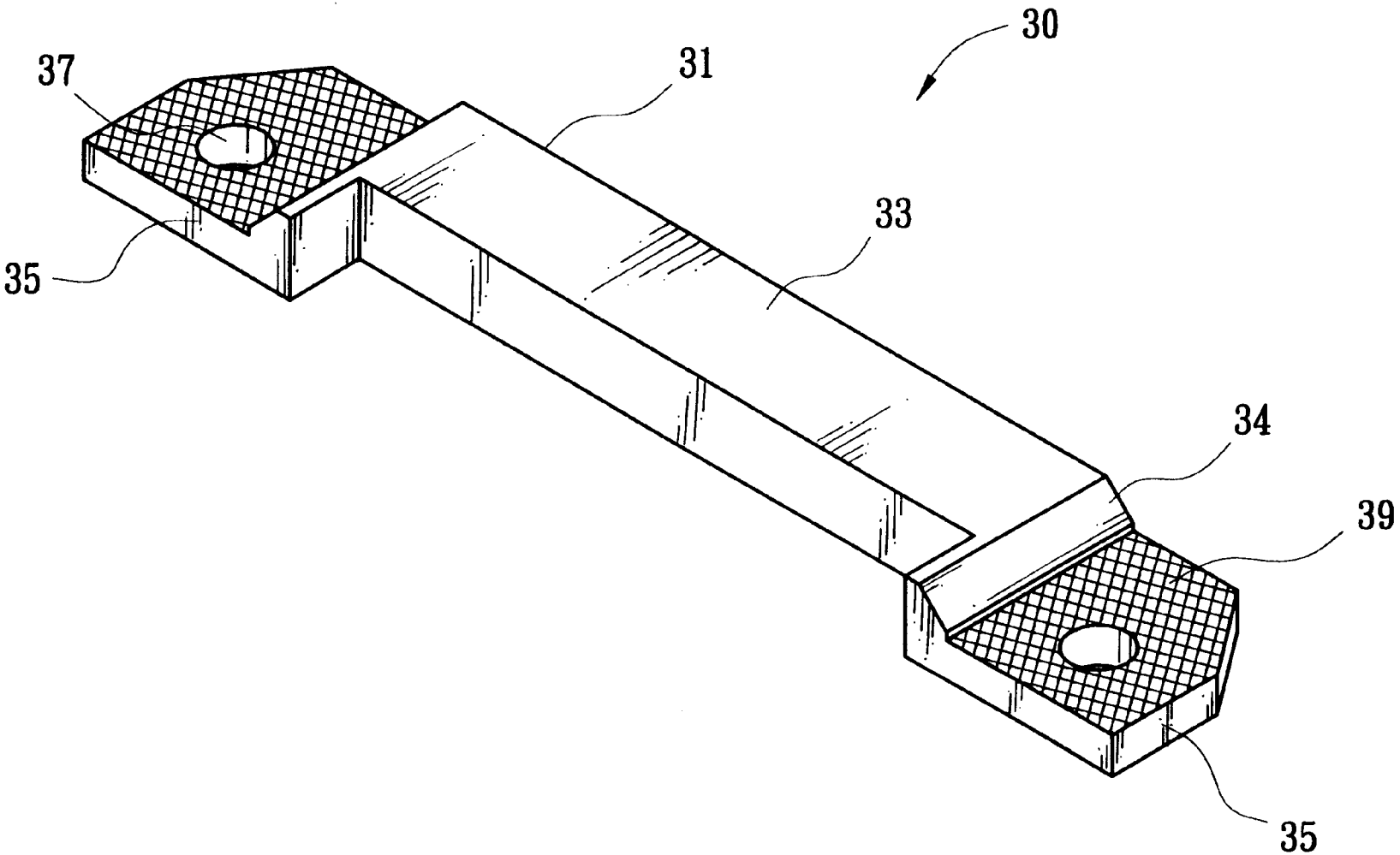
FIG. 8 is a perspective view of another embodiment of the present invention.

There are some variations on the connecting portion 32, for example, referring to FIG. 4, to make the surface of the connecting portion 32 to a rough surface 39. Referring now to FIG. 8, after practicing this, the grasp force between these two connecting portions 32 increases.

Figure 9A:
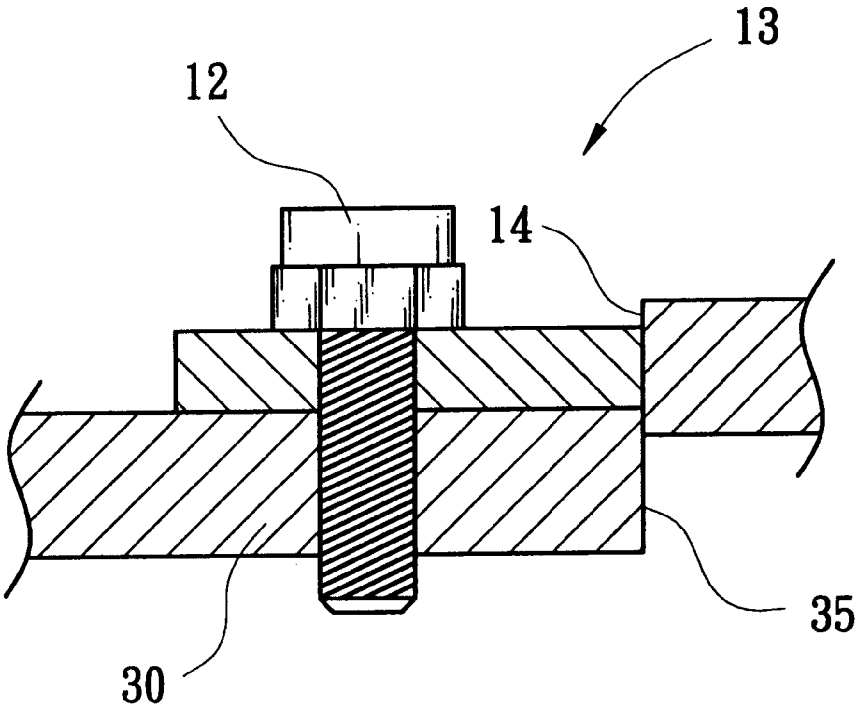
FIGS. 9A and 9B are perspective views of FIG. 4, depicting the contacting status between the face of connecting part and the face of the terminal.
Figure 9B:
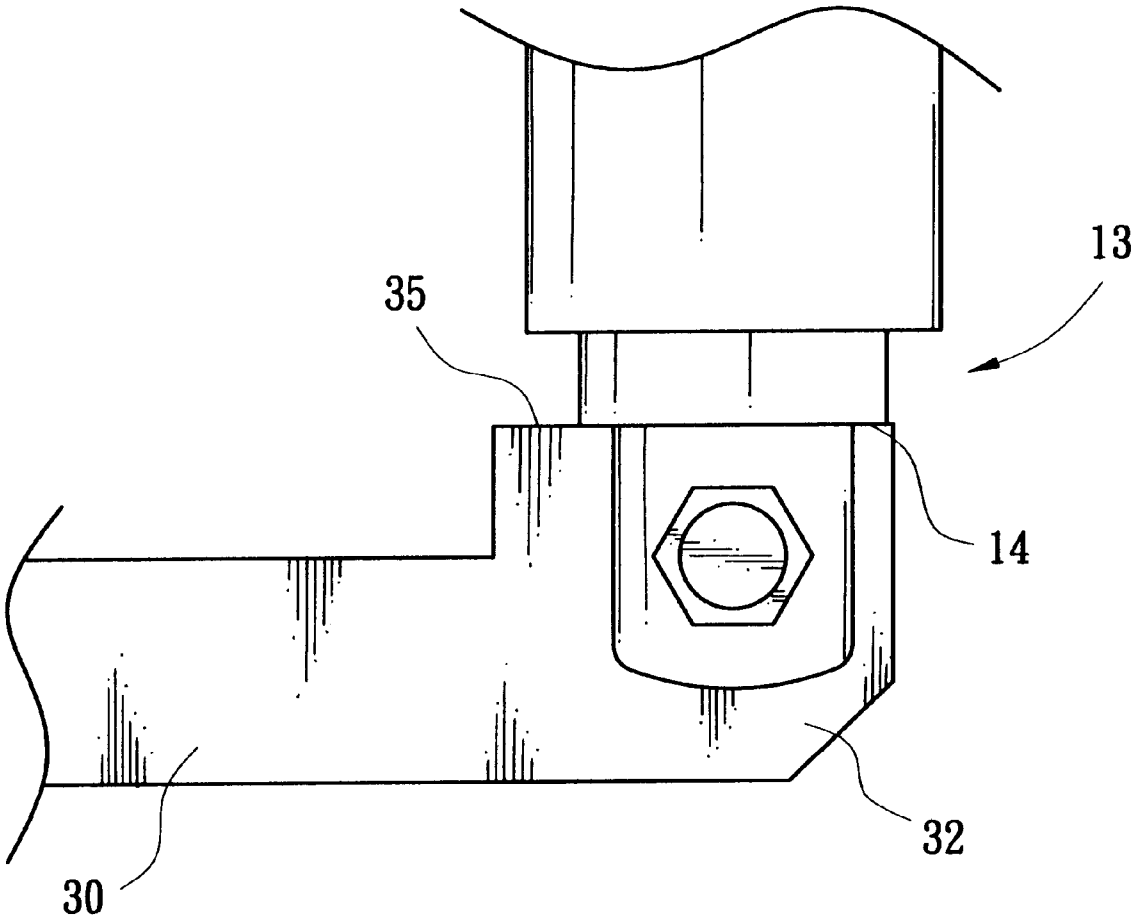

When assembling link bars to capacitors 20, it is always needed to add a terminal 13 on the end of the connecting portion 32 in order to electrically connect a wire. At this moment, the connecting portion 32 of the present invention have four end faces 35 thereon and contact face to face with the end face 14 of the terminal 13 very tightly so that there is no clearance between the end face 35 and the end face 14. Referring to FIGS. 9A and 9B, with the supporting of the end face 14, the terminal 13 is free from rotating during locking process. It is important that the length of the end face 35 is longer than that of the end face 14 in order to secure that the full area of the end face 14 can contact the end face 35 so as to offer sufficient supporting force and that the terminal 13 does not rotate. In order to broaden the application, the length of the end face 35 differs and is designed to meet the length of the end face 14.

EFFECTS OF THE INVENTION

1. The link bar of the present invention can be mutually assembled to form a serial link bar which has the desired number of locking holes for connecting capacitors and the cost for manufacturing one single type of link bar can be reduced.
2. There is an end surface on the connecting portion of the link bar and it contacts the other end surface by means of face to face, therefore, meets to each other tightly and has no clearance between both end surfaces, which prevents the connection during locking process from wobbling.

Numerous variations and modifications will suggest themselves to persons skilled in the arts, other than those already described, without departing the basic inventive concepts. Although the present invention has been described with respect to typical preferred embodiments thereof, it should be understood that the present inventions is not limited to these embodiments, and various changes or modifications may be made without departing from the scope of the present invention as defined by the appended claims.

What is claimed is:

1. A set of link bars for capacitors of an audio system comprising:

a conducting portion having a first height dimension; and a plurality of connecting portions, the connecting portions having a second height dimension, the conducting portion extends between the connecting portions, whereby electrical poles of capacitors can be connected by the link bar; and means for connecting a plurality of link bars to form a series of link bars whereby more than two capacitors are connectable, the means for connecting including the first height dimension being greater than the second height dimension whereby a connecting portion of a first link bar is directly connectable with a connecting portion of a second link bar in an overlapping relationship, the heights of the connected link bars being generally uniform with a height of an overlapping portion of the connection portions being generally equal to the first height dimension.

2. The link bar set for capacitors of an audio system according to claim 1, wherein the means for connecting enables the plurality of link bars to be linearly connected.

3. The link bar set for capacitors of an audio system according to claim 1, wherein the first height dimension is twice the second height dimension.

4. The link bar set for capacitors of an audio system according to claim 1, wherein at least one of the connecting portions includes at least one locking hole lockable to an electrical pole of a capacitor.

5. The link bar set for capacitors of an audio system according to claim 1, wherein the means for connecting enables a plurality of link bars to be connected in series with connecting portions of adjacent link bars being in direct contact with one another.

6. The link bar set for capacitors of an audio system according to claim 1, wherein the connecting portions each have at least one end face.

7. The link bar set for capacitors of an audio system according to claim 6, wherein the faces of the connecting portions are flat.

8. The link bar set for capacitors of an audio system according to claim 6, wherein a plurality of end faces are provided on at least one of the connecting portions, the end faces having different lengths for contact with terminals of different sizes.

9. The link bar set for capacitors of an audio system according to claim 8, wherein at least four end faces are provided on the at least one connecting portion.

10. The link bar set for capacitors of an audio system according to claim 1, wherein at least one surface of the connecting portion is rough.

11. A method for connecting a plurality of capacitors, the method comprising the steps of:

providing a plurality of link bars, each of the link bars having a conducting portion and first and second connecting portions, the connecting portions being at ends of the conducting portion and having a decreased thickness as compared to the respective conducting portion;

placing a connecting portion of a first link bar adjacent an electrical pole of a capacitor;

putting a connecting portion of a second link bar adjacent the connecting portion of the first link bar, the connecting portions of the first and second link bars being in contact and having a combine thickness generally equal to a thickness of the connecting portion of either link bar;

fastening the connecting portions of the first and second link bars to the capacitor;

connecting a second connecting portion of the first link bar to a second capacitor; and connecting a second connecting portion of the second link bar to a third capacitor to form a series of link bars, whereby the first, second and third capacitors are connected and a top surface of the series of link bars is generally flush.

12. The method for connecting according to claim 11, wherein a height of the connecting portions of each link bar is less than a height of the conducting portion of the link bar and wherein the step of putting a connecting portion of the second link bar adjacent the connecting portion of the first link bar includes the step of overlapping the first and second link bars, a height of connected link bars being generally uniform through the conducting portions and the overlapped connecting portions.

13. The method for connecting according to claim 11, comprising the step of connecting link bars in series so that more than three capacitors are electrically connected.

* * * * *